US010145272B2

(12) United States Patent
Yamane et al.

(10) Patent No.: US 10,145,272 B2
(45) Date of Patent: Dec. 4, 2018

(54) ROCKER ARM

(71) Applicant: OTICS CORPORATION, Aichi (JP)

(72) Inventors: Naoyuki Yamane, Nishio (JP); Kiyoshi Masegi, Nishio (JP); Kimihiko Todo, Nishio (JP)

(73) Assignee: OTICS CORPORATION, Aichi (JP)

( * ) Notice: Subject to any disclaimer, the term of this patent is extended or adjusted under 35 U.S.C. 154(b) by 73 days.

(21) Appl. No.: 15/435,584

(22) Filed: Feb. 17, 2017

(65) Prior Publication Data

US 2017/0292413 A1 Oct. 12, 2017

(30) Foreign Application Priority Data

Apr. 8, 2016 (JP) ..... 2016-078043

(51) Int. Cl.
*F01L 1/18* (2006.01)
*F01L 1/047* (2006.01)

(52) U.S. Cl.
CPC ..... *F01L 1/181* (2013.01); *F01L 1/047* (2013.01); *F01L 1/185* (2013.01); *F01L 2105/00* (2013.01); *F01L 2105/02* (2013.01); *Y10T 74/20582* (2015.01); *Y10T 74/20882* (2015.01)

(58) Field of Classification Search
CPC ..... F01L 1/181; F01L 1/047; F01L 2105/00; F01L 2105/02; F01L 1/185; Y10T 74/20582; Y10T 74/20882
See application file for complete search history.

(56) References Cited

U.S. PATENT DOCUMENTS 1,802,330 A * 4/1931 Boland ..... F01L 1/14 123/90.5
3,822,683 A * 7/1974 Clouse ..... F02M 59/44 123/90.5
5,239,951 A * 8/1993 Rao ..... F01L 1/14 123/90.5
6,003,482 A * 12/1999 Kampichler ..... F01L 1/183 123/90.41
6,463,897 B2 * 10/2002 Fernandez ..... F01L 1/182 123/90.15
7,497,157 B2 * 3/2009 Aoki ..... F02M 47/027 74/569

FOREIGN PATENT DOCUMENTS

JP 2008-075482 4/2008

* cited by examiner

*Primary Examiner* — Mark A Laurenzi
*Assistant Examiner* — Wesley G Harris
(74) *Attorney, Agent, or Firm* — Wenderoth, Lind & Ponack, L.L.P.

(57) ABSTRACT

A rocker arm includes a roller, a support shaft coaxially mounted in the roller and having a first end portion and a second end portion, walls including at least a first wall and a second wall arranged along the rotation axis and opposite each other with having the roller therebetween, the first wall having a first through hole through which the first end portion is inserted and the second wall having a second through hole through which the second end portion is inserted, and plate portions including at least a first plate portion and a second plate portion arranged opposite each other with having the first wall, the second wall and the support shaft therebetween. The first plate portion is in contact with a first end surface of the first end portion and the second plate portion is in contact with a second end surface of the second end portion.

16 Claims, 5 Drawing Sheets

ROCKER ARM

CROSS REFERENCE TO RELATED APPLICATION

This application claims priority from Japanese Patent Application No. 2016-78043 filed on Apr. 8, 2016. The entire contents of the priority application are incorporated herein by reference.

FIELD OF THE INVENTION

The present disclosure relates to a rocker arm.

BACKGROUND OF THE INVENTION

A rocker arm that transmits pressure force from a cam to a valve in a vehicular engine has been known. The rocker arm includes a roller that is in contact with the cam. The roller is rotatably supported by a support shaft. The support shaft is mounted on a pair of walls that sandwich the roller therebetween and the support shaft and the walls are fastened together with a fixing member.

SUMMARY OF THE INVENTION

In the above fastening configuration of the support shaft and the walls, a cylindrical support shaft necessarily has a great thickness to ensure fastening strength. Accordingly, an outer diameter of the support shaft is likely to be increased and the rocker arm is less likely to be reduced in size.

The present technology has been made in view of the aforementioned circumstances. An objective of the present technology is to provide a rocker arm that is reduced in size.

To solve the above problem, according to the present technology, a rocker arm includes a roller to be contacted with a cam and having a rotation axis, a support shaft having a columnar shape, extending along the rotation axis and coaxially mounted in the roller to rotatably support the roller, the support shaft having a first end portion and a second end portion, walls including at least a first wall and a second wall extending perpendicular to the rotation axis and opposite each other with the roller located therebetween, the first wall having a first through hole through which the first end portion of the support shaft is inserted and the second wall having a second through hole through which the second end portion of the support shaft is inserted, a bearing arranged between the support shaft and the roller, and plate portions including at least a first plate portion and a second plate portion arranged opposite each other with the first wall, the second wall and the support shaft located therebetween. The first plate portion is in contact with a first end surface of the first end portion of the support shaft and the second plate portion is in contact with a second end surface of the second end portion of the support shaft.

DETAILED DESCRIPTION OF THE PREFERRED EMBODIMENTS

<First Embodiment>

Figure 1:
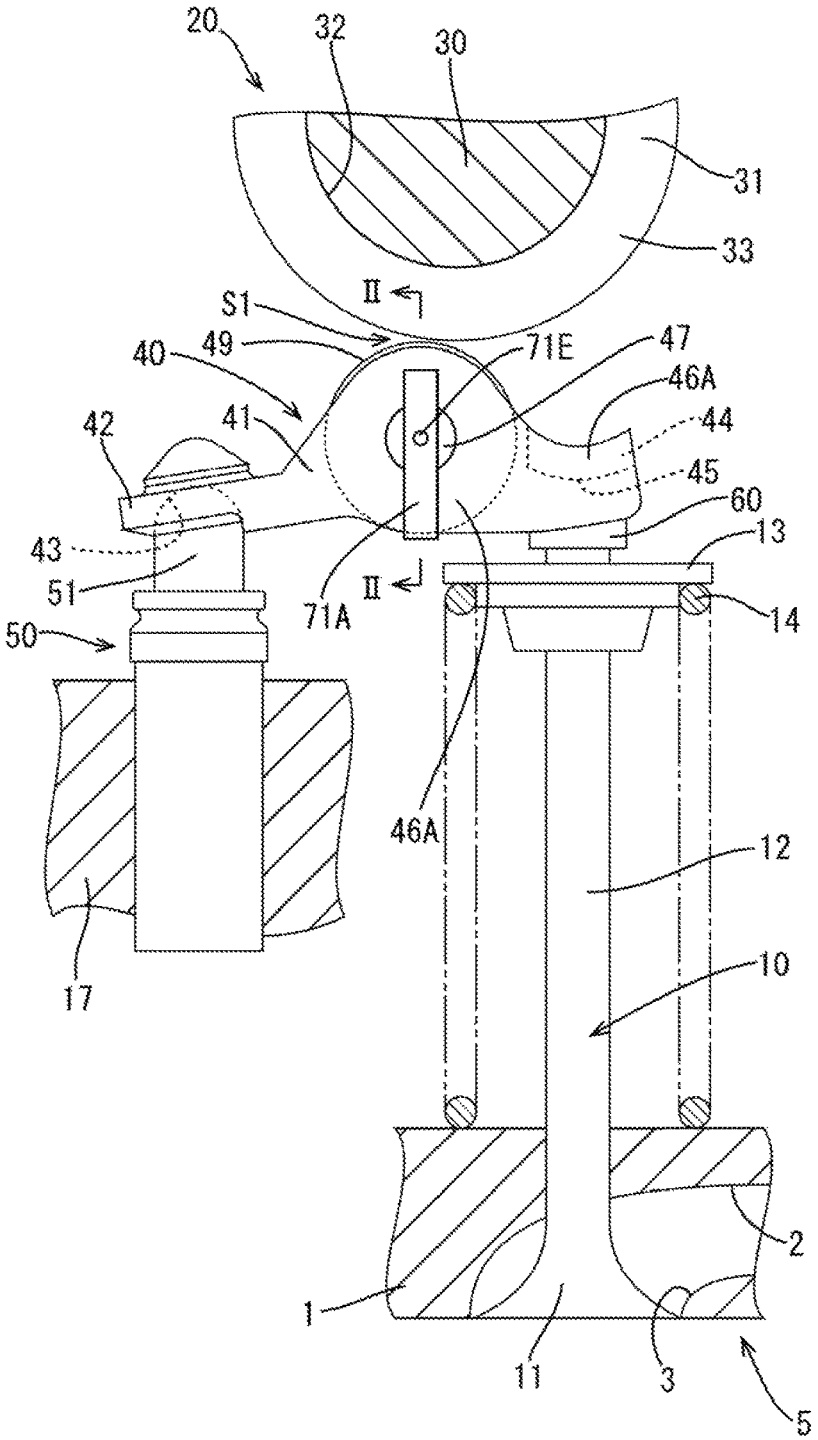
FIG. 1 is a cross-sectional view illustrating a vehicular engine according to a first embodiment of the present technology.

A first embodiment of the present technology will be described with reference to FIGS. 1 and 2. As illustrated in FIG. 1, a vehicular engine 5 of this embodiment includes a cylinder head 1, a cam housing 17 mounted on an upper side with respect to the cylinder head 1, and a valve drive device 20. The cylinder head 1 includes an intake valve 10 that opens and closes an intake port 3 and a discharge valve (not illustrated) that opens and closes a discharge port. Hereinafter, the intake valve 10 and the valve drive device 20 that is on an intake side and opens and closes the intake valve 10 will be described in detail. The discharge valve and a valve drive device on a discharge side have configurations similar to those of the intake side.

The intake valve 10 includes a valve stem 12 having a bar shape and a valve member 11 having a disk-like shape. The valve member 11 is at a lower end of the valve stem 12. The valve member 11 is arranged in an intake passage 2 included in the cylinder head 1. The intake passage 2 communicates with an inner space of a cylinder (not illustrated). The valve member 11 opens and closes an intake port 3 that communicates with the cylinder and the intake passage 2. The valve stem 12 passes through an outer wall of the intake passage 2 and an upper end portion of the valve stem 12 projects outside (on an upper side in FIG. 1) the intake passage 2.

A spring retainer 13 having a disk-like shape is mounted on the upper end portion of the valve stem 12. A valve spring 14 is mounted between an outer surface (an upper surface) of the cylinder head 1 and the spring retainer 13. The valve spring 14 is compressed from a normal state (having a normal length). The intake valve 10 is urged toward the rocker arm 40 (upward in FIG. 1) by an elastic force of the valve spring 14 and the valve member 11 is urged to close the intake port 3.

The valve drive device 20 opens and closes the intake valve 10. The valve drive device 20 includes a cam 31, a camshaft 30 inserted in the cam 31, a rocker arm 40, and a pivot 50. The rocker arm 40 is pivoted according to rotation of the cam 31 and converts the rotation movement of the cam 31 to up-down movement. The rocker arm 40 transfers the converted up-down movement to the intake valve 10. The pivot 50 has a pivot support point of the rocker arm 40 and is mounted on the cam housing 17. A lash adjuster may be used instead of the pivot 50.

The camshaft 30 is a hollow round bar and is arranged away from the distal end of the valve stem 12 and perpendicular to the valve stem 12. The camshaft 30 is rotatably supported between the cam housing 17 and a cam cap (not illustrated). The cam 31 is fixed to the camshaft 30. The cam 31 has a plate-like shape and an egg shape from a front view and has a shaft hole 32 where the camshaft 30 is inserted. The shaft hole 32 is a through hole that extends through the cam 31 from one plate surface to another plate surface. The cam 31 is fixed to the camshaft 30 and rotatable together with the camshaft 30. The cam 31 includes a base portion 33 and a cam nose portion (not illustrated). The cam 31 has a constant distance from a rotation center (a center of the shaft hole 32) to an outer peripheral edge at the base portion 33. The cam 31 has a distance from the rotation center (the center of the shaft hole 32) to the outer peripheral edge at the cam nose portion 33 that is greater than that of the base portion 33.

The rocker arm 40 has an elongated shape extending in a direction perpendicular to the rotation axis of the cam 31 (in a right-left direction in FIG. 1) and perpendicular to an elongated direction of the valve stem 12. The rocker arm 40 is arranged between the cam 31 and the valve stem 12. The rocker arm 40 includes a roller 49 that is in contact with the cam 31 and an arm main body 41 that rotatably holds the roller 49. The arm main body 41 has a pivot support portion 42 at one end portion thereof so as to be supported by the pivot 50 such that the arm main body 41 is able to be pivoted. The arm main body 41 has a valve contact portion 44 (a dotted line in FIG. 1) at another end portion thereof. The valve contact portion 44 is in contact with the intake valve 10 via a shim 60.

The shim 60 is a spacer between the valve stem 12 and the valve contact portion 44. A preferable one is selected for the shim 60 among shims having various thicknesses. A clearance S1 between the cam 31 and the roller 49 is adjusted by adjusting the thickness of the shim 60. The shim 60 mounted on the valve stem 12 according to the present embodiment may be called a stem cap or a stem end cap.

The pivot support portion 42 has a shape following a distal end portion 51 of the pivot 50 and has a spherical recessed portion 43 (illustrated by a broken line in FIG. 1) on a lower surface thereof. The spherical recessed portion 43 receives the distal end portion 51 of the pivot 50. As illustrated by a broken line in FIG. 1, the valve contact portion 44 has a valve receiving surface 45 on a lower surface thereof and the valve receiving surface 45 is in contact with the shim 60 and is a curved surface projecting toward the shim 60.

In the present embodiment, when the base portion 33 of the cam 31 is opposite the roller 49 (in a base state), the intake valve 10 is urged upward by the valve spring 14 with urging force of the valve spring 14 and in a closed state. Namely, the valve member 11 closes the intake port 3. When the cam nose portion of the cam 31 is in contact with the roller 49 (in a lift state), the cam 31 presses the rocker arm 40 downward. Accordingly, the intake valve 10 is pressed down by the valve contact portion 44 and is in an open state.

Figure 2:
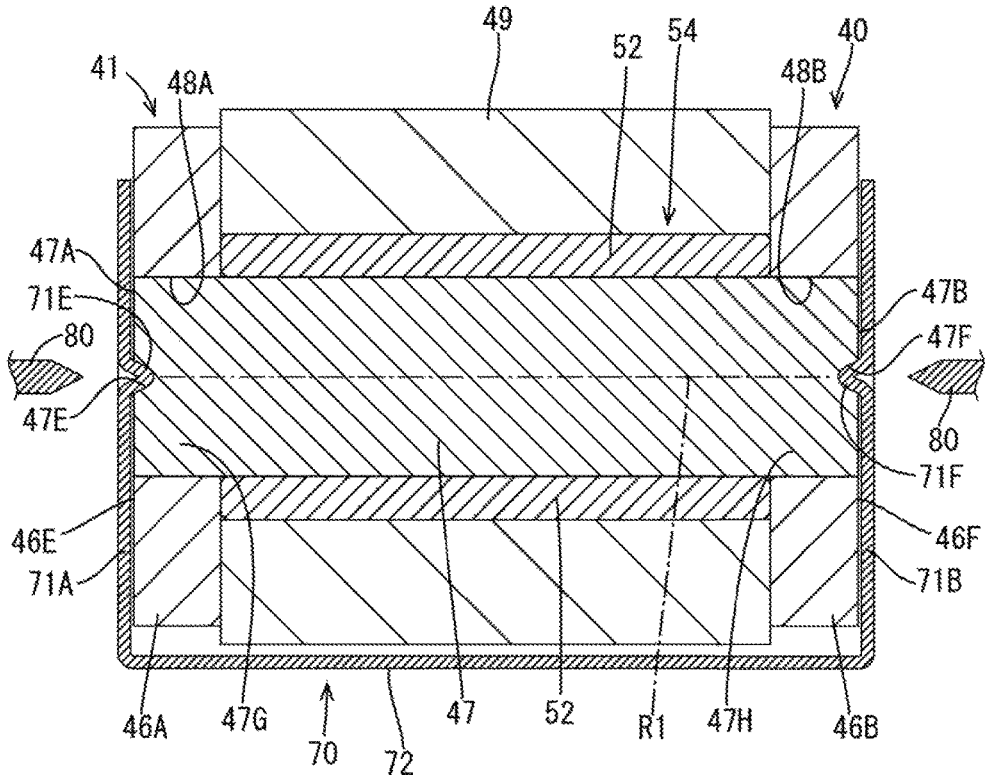
FIG. 2 is a cross-sectional view of a rocker arm in FIG. 1 taken along line II-II in FIG. 1.

As illustrated in FIG. 2, the arm main body 41 includes a pair of walls including a first wall 46A and a second wall 46B. The first wall 46A and the second wall 46B are opposite each other with the roller 49 therebetween. The first wall 46A and the second wall 46B extend perpendicular to an axial direction of a rotation axis R1 of the roller 49 (in a right-left direction in FIG. 2). A support shaft 47 is mounted in the first and second walls 46A, 46B. The support shaft 47 rotatably supports the roller 49 and is a shaft member that sets the rotation axis R1 of the roller 49. The support shaft 47 has a columnar shape extending along the rotation axis R1. The support shaft 47 is subjected to a hardening treatment with immersion quenching.

As illustrated in FIG. 2, the roller 49 has a cylindrical shape and a bearing 54 is arranged between the roller 49 and the support shaft 47. The bearing 54 is a roller bearing and includes columnar rolling members 52 (rollers) that are arranged around the rotation axis R1 in a ring shape. According to such a configuration, the roller 49 is rotatable with respect to the support shaft 47 around the rotation axis R1. An upper surface of the roller 49 is above upper surfaces of the first and second walls 46A, 46B. In other words, an outer peripheral surface of the roller 49 extends beyond distal end surfaces of the first and second walls 46A, 46B with respect to the rotation axis R1. According to such a configuration, the roller 49 can contact the outer peripheral surface of the cam 31 where the roller 49 extends upward beyond the upper surfaces of the walls 46A, 46B.

The first wall 46A has a through hole 48A (a first through hole) through which a first end portion 47G of the support shaft 47 is inserted. The second wall 46B has a through hole 48B (a second through hole) through which a second end portion 47H of the support shaft 47 is inserted. The support shaft 47 is held by a holding member 70 so as not to fall off from the through holes 48A, 48B. The through holes 48A, 48B are circular holes following an outer shape of the support shaft 47. The support shaft 47 is rotatable around the rotation axis R1 with respect to the first and second walls 46A, 46B.

The holding member 70 is made of metal and includes a pair of plate portions 71A, 71B and a connecting member 72. The plate portions include a first plate portion 71A and a second plate portion 71B that are opposite each other with the first wall 46A and the second wall 46B therebetween. The connecting portion 72 connects the first plate portion 71A and the second plate portion 71B and has a plate shape. The connecting portion 72 is on an opposite side from the cam 31 (on a lower side in FIG. 2) with respect to the first and second walls 46A, 46B. As illustrated in FIG. 2, the holding member 70 includes the first plate portion 71A and the second plate portion 71B and the connecting portion 72 that form a U-shape. Each of the first and second walls 46A, 46B has an inner surface that is in contact with the roller 49 and an outer surface 46E, 46F that is an opposite surface from the inner surface. The support shaft 47 has a first end surface 47A at the first end portion 47G and a second end surface 47B at the second end portion 47H. As illustrated in FIG. 2, in this embodiment, the outer surface 46E is flush with the first end surface 47A and the outer surface 46F is flush with the second end surface 47B.

The first plate portion 71A is in contact with the outer surface 46E of the first wall 46A and the first end surface 47A of the support shaft 47. As illustrated in FIG. 2, the first plate portion 71A overlaps a part of the outer surface 46E and the first end surface 47A. The second plate portion 71B is in contact with the outer surface 46F of the second wall 46B and the second end surface 47B of the support shaft 47. Similar to the first plate portion 71A, the second plate portion 71B overlaps a part of the outer surface 46F and the second end surface 47B. The first and second plate portions 71A, 71B cover the respective first and second end surfaces 47A, 47B of the support shaft 47. Accordingly, the support shaft 47 is less likely to be dropped from the through holes 48A, 48B.

As illustrated in FIG. 2, the first and second plate portions 71A, 71B have first and second projections 71E, 71F, respectively. The first plate portion 71A has the first projection 71E on an inner surface thereof, and the inner surface of the first plate portion 71A is in contact with the outer surface 46E and the first end surface 47A. The second plate portion 71B has the second projection 71F on an inner surface thereof, and the inner surface of the second plate portion 71B is in contact with the outer surface 46F and the second end surface 47B.

The first end surface 47A of the support shaft 47 has a circular shape and has a first recess portion 47E at a center thereof. The first recess portion 47E has a conical shape. The first projection 71E of the first plate portion 71A is fit in the first recess portion 47E. The second end surface 47B of the support shaft 47 has a circular shape and has a second recess portion 47F at a center thereof. The second recess portion 47F has a conical shape. The second projection 71F of the second plate portion 71B is fit in the second recess portion 47F. Accordingly, the holding member 70 is fixed to the support shaft 47. Namely, the support shaft 47 is fixed to the holding member 70 so as to be rotatable around the first and second recess portions 47E, 47F.

The first and second recess portions 47E, 47F and the support shaft 47 are coaxially arranged. A recessed end point of each recess portion 47E, 47F is on the rotation axis R1. According to such a configuration, rotation of the support shaft 47 with respect to the first and second walls 46A, 46B is not hindered by the first and second projections 71E, 71F. The first projection 71E is formed by pressing and bending a part of the first plate portion 71A toward the support shaft 47 with a punch 80 as illustrated in FIG. 2. The second projection 71F is formed by pressing and bending a part of the second plate portion 71B toward the support shaft 47 with the punch 80. The method of forming the first and second projections 71E, 71F is not limited to the above one.

Next, advantageous effects of the present embodiment will be described. According to the present embodiment, the support shaft 47 is sandwiched by the first and second plate portions 71A, 71B and an axial position of the support shaft 47 is determined by the first and second plate portions 71A, 71B. With such a configuration, the support shaft 47 is rotatably fixed to the first and second walls 46A, 46B without fastening. With the configuration where the support shaft is fastened to the walls, the cylindrical support shaft necessarily has a fastening portion at an outer peripheral portion and a large fastening portion is required to ensure effective fastening strength. Therefore, an outer diameter of the support shaft is likely to be increased.

In the present embodiment, the first and second end portions 47G, 47H of the support shaft 47 are inserted in the respective through holes 48A, 48B of the first and second walls 46A, 46B and the first and second end surfaces 47A, 47B of the first and second end portions 47G, 47H are in contact with the respective plate portions 71A, 71B. Accordingly, the support shaft 47 is rotatably mounted in the first and second walls 46A, 46B. According to such a configuration, in the present embodiment without having a fastening configuration, the support shaft does not need to include a fastening portion and fastening strength does not need to be ensured. Therefore, the support shaft 47 has a smaller outer diameter compared to that in the configuration with the fastening configuration.

According to the present embodiment, the first and second projections 71E, 71F are fitted in the first and second recess portion 47E, 47F, respectively, such that the first and second plate portions 71A, 71B are fixed to the support shaft 47. The first and second recess portions 47E, 47F are formed in a center portion of each end surface of the support shaft 47. Therefore, in a mounted state where the first projection 71E is fit in the first recess portion 47E and the second projection 71F is fit in the second recess portion 47F, the first and second projections 71E, 71F do not hinder rotation of the support shaft 47 and the support shaft 47 is fixed by the first and second walls 46A, 46B and the holding member 70 so as to be rotatable with respect to the first and second walls 46A, 46B and the holding member 70.

In the present embodiment, the support shaft 47 is fixed in the first and second walls 46A, 46B to be rotatable with respect to the first and second walls 46A, 46B without fastening. When the rocker arm 40 is moved, the support shaft 47 receives pressing force from the cam 31 and receives a load (radial load) on a surface thereof opposite the cam 31. If the support shaft is fixed to the walls so as not to be rotatable, the support shaft always receives a load on a same portion (a surface opposite the cam) and abrasion is likely to be caused on the portion receiving the load. In the above configuration where the support shaft 47 is rotatable, when the rocker arm 40 is moved, the support shaft 47 is rotated according to rotation of the roller 49. Therefore, the support shaft 47 receives the load from the cam 31 on a different portion in a circumferential direction of the support shaft 47. Accordingly, abrasion is less likely to be caused in only a certain portion of the support shaft 47 and the support shaft 47 has a long life.

In the present embodiment, the first plate portion 71A is in contact with the outer surface 46E of the first wall 46A and the first end surface 47A of the support shaft 47. In such a configuration, the first plate portion 71A is positioned more precisely than the configuration where the plate portion is in contact with only the support shaft and the support shaft 47 is positioned precisely.

<Second Embodiment>

Figure 3:
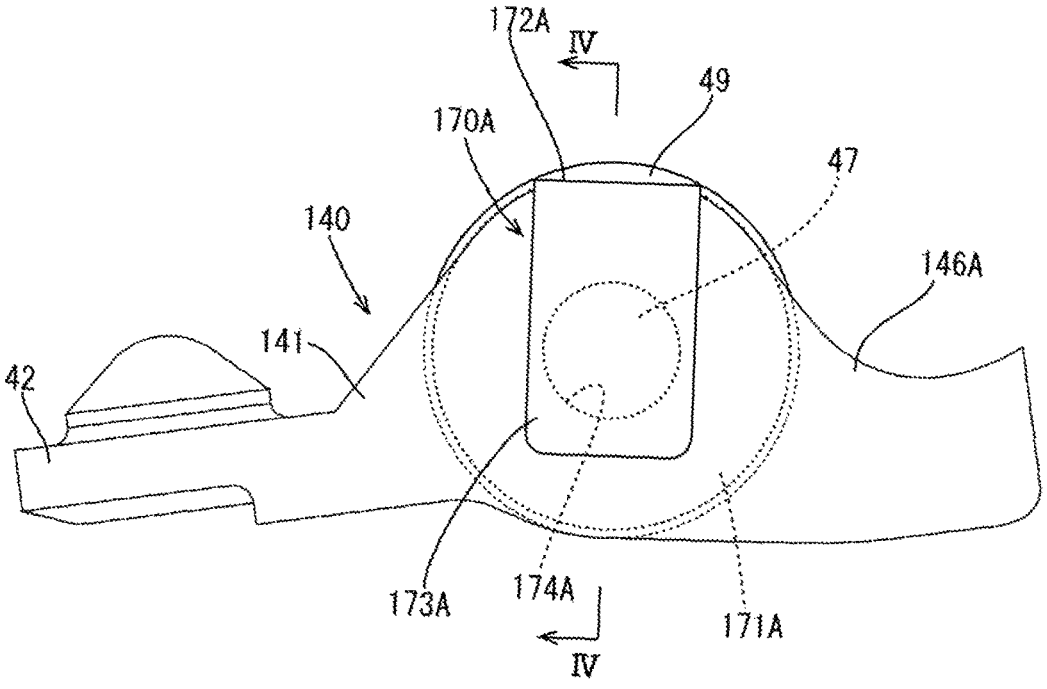
FIG. 3 is a side view of a rocker arm according to a second embodiment.
Figure 4:
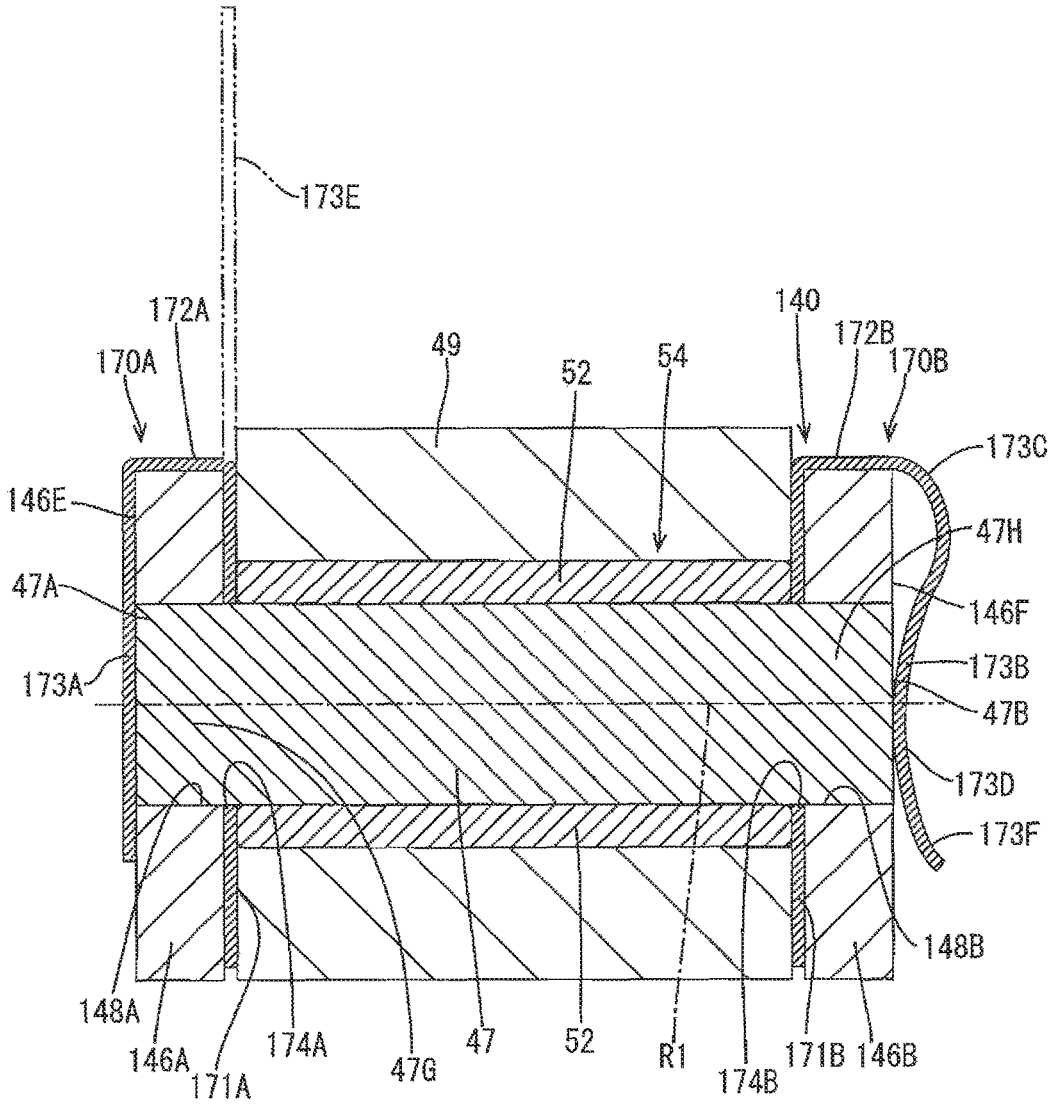
FIG. 4 is a cross-sectional view of the rocker arm in FIG. 3 taken along line IV-IV in FIG. 3.

Next, a second embodiment of the present invention will be described with reference to FIGS. 3 to 5. In the second embodiment, a configuration of holding member differs from that of the first embodiment. The parts same as those in the first embodiment have same symbols as those in the first embodiments and will not be described. As illustrated in FIGS. 3 and 4, a rocker arm 140 includes a pair of holding members including a first holding member 170A and a second holding member 170B. The rocker arm 140 includes an arm main body 141 and the arm main body 141 includes a pair of walls 146A, 146B including a first wall 146A and a second wall 146B. The first and second walls 146A, 146B are opposite each other with having the roller 49 therebetween. The first holding member 170A is mounted on the first wall 146A and the second holding member 170B is mounted on the second wall 146B.

As illustrated in FIG. 4, the first holding member 170A includes a first stopper portion 171A, a first plate portion 173A, and a first connection portion 172A. The first stopper portion 171A is stopped by the first wall 146A and holds the first wall 146A from a roller 49 side. The first plate portion 173A covers the support shaft 47 from outside. The first connecting portion 172A connects the first stopper portion 171A and the first plate portion 173A.

Figure 5:
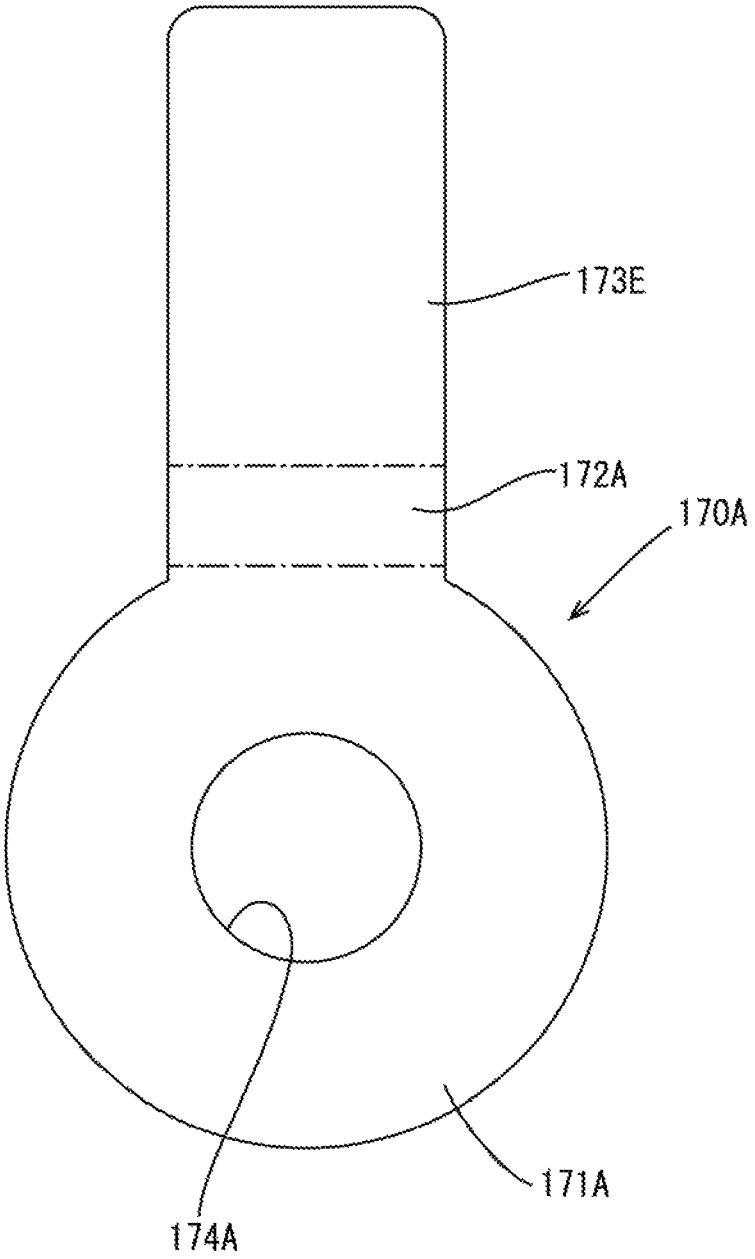
FIG. 5 is a plan view of a holding member 170A before being mounted on a wall.

The first holding member 170A is made of metal and has a shape illustrated in FIG. 5 before bending. The first holding member 170A illustrated in FIG. 4 is formed by bending the metal plate in FIG. 5. As illustrated in FIGS. 4 and 5, the first stopper portion 171A is arranged between the first wall 146A and the roller 49 and has a circular shape smaller than the end surface (having a circular shape) of the roller 49. The first stopper portion 171A has a insertion hole 174A (a first insertion hole) that overlaps the through hole 148A of the first wall 146A. The first end portion 47G of the support shaft 47 passes through the through hole 148A and the insertion hole 174A. The support shaft 47 is rotatably fixed in the first holding member 170A.

Each of the first and second walls 146A, 146B has an inner surface and an outer surface. The inner surface is in contact with each of the first and second stopper portions 171A, 171B and the outer surface 146E, 146F is opposite surface from the inner surface. As illustrated in FIG. 4, in this embodiment, the outer surface 146E is flush with the first end surface 47A and the outer surface 146F is flush with the second end surface 47B.

The first plate portion 173A is in contact with the outer surface 146E of the first wall 146A and the first end surface 47A of the support shaft 47. The first plate portion 173A covers the outer surface 146E and the first end surface 47A. The first connecting portion 172A covers an upper surface of the first wall 146A from the cam 31 side (from an upper side in FIG. 4) and is arranged to be in contact with a cam-side surface of the first wall 146A. The first plate portion 173A extends from an outer end of the first connecting portion 172A downwardly to be away from the cam 31 and covers at least a center (the rotation axis R1) of the support shaft 47.

The second holding member 170B is made of metal. As illustrated in FIG. 4, the second holding member 170B includes a second stopper portion 171B, a second plate portion 173B, and a second connection portion 172B. The second stopper portion 171B is stopped by the second wall 146B and holds the second wall 146B from a roller 49 side. The second plate portion 173B covers the support shaft 47 from outside. The second connecting portion 172B connects the second stopper portion 171B and the second plate portion 173B. As illustrated in FIG. 4, the second stopper portion 171B is arranged between the second wall 146B and the roller 49 and has a circular shape smaller than the end surface (having a circular shape) of the roller 49. The second stopper portion 171B has an insertion hole 174B (a second insertion hole) that overlaps the through hole 148B of the second wall 146B. The second end portion 47H of the support shaft 47 passes through the through hole 148B and the insertion hole 174B. The support shaft 47 is rotatably fixed in the second holding member 170B, and the support shaft 47 is rotatable with respect to the first and second walls 146A, 146B and the first and second holding members 170A, 170B.

The second plate portion 173B is in contact with the outer surface 146F of the second wall 146B and the second end surface 47B of the support shaft 47. The second plate portion 173B covers the outer surface 146F and the second end surface 47B. The second connecting portion 172B covers an upper surface of the second wall 146B from the cam 31 side (from the upper side in FIG. 4) and is arranged to be in contact with a cam-side surface of the second wall 146B. As illustrated in FIG. 4, the second plate portion 173B extends from an outer end of the second connecting portion 172B downwardly to be away from the cam 31 and has a curved shape (S-shape) such that a middle portion 173D thereof projecting toward the support shaft 47. Specifically, the second plate portion 173B has a basal portion 173C extending from the outer end of the second connecting portion 172B and the basal portion 173C is spaced from the outer surface 146F. A space is between the basal portion 173C and the outer surface 146F. The middle portion 173D of the second plate portion 173B is in contact with the second end surface 47B of the support shaft 47. The second plate portion 173B has a distal end portion 173F that is away from the outer surface 146F. The second plate portion 173B covers at least a center (the rotation axis R1) of the support shaft 47.

Before the second holding member 170B is mounted on the second wall 146B, a distance between the middle portion 173D and the second stopper portion 171B is slightly smaller than a thickness of the second wall 146B. Therefore, the middle portion 173D is elastically in contact with a middle portion of the second end surface 47B of the support shaft 47. Namely, the second holding member 170B urges the support shaft 47 toward the first plate portion 173A at the middle portion 173B. As illustrated in FIG. 4, the first and second connecting portions 172A, 172B (cam-side surfaces of the first and second connecting portions 172A, 172B, upper surfaces in FIG. 4) are closer to a rotation axis of the roller 49 (on a lower side in FIG. 3) than the outer peripheral surface of the roller 49. The middle portion 173D may not necessarily be in contact with the center of the second end surface 47B of the support shaft 47. With the middle portion 173D that is in contact with the center of the second end surface 47B of the support shaft 47, the second holding member 170B can hold the support shaft 47 stably.

Next, steps of mounting the first and second holding members 170A, 170B and the support shaft 47 in the rocker arm are described according to the present embodiment. As illustrated in FIG. 4, the second holding member 170B is mounted on the second wall 146B. The second wall 146B is easily inserted through an open space between the second plate portion 171B and the distal end portion 173F and further inserted through the space between the second plate portion 171B and the middle portion 173D with pressing the middle portion 173D outwardly to enlarge the space against an urging force of the middle portion 173D. Then, the metal plate including a plate portion 173E before bending as illustrated in FIGS. 4 ad 5 is arranged between the roller 49 and the first wall 146A.

Next, the support shaft 47 is inserted through the through hole 148A, the insertion hole 174A, a through hole of the bearing 54, the insertion hole 174B, and the through hole 148B in this order. Then, the plate portion 173E is bent at the upper surface of the first wall 146A to cover the first end surface 47A. Accordingly, the first and second end surfaces 47A, 47B of the support shaft 47 are covered with the first and second plate portions 173A, 173B, respectively, and the support shaft 47 is not dropped from the through holes 148A, 148B.

According to the present embodiment, the first plate portion 173A is mounted on the first wall 146A and the second plate portion 173B is mounted on the second wall 146B. The first stopper portion 171A is between the roller 49 and the first wall 146A, and the roller 49 is not directly in contact with the first wall 146A. The second stopper portion 171B is between the roller 49 and the second wall 146B, and the roller 49 is not directly in contact with the second wall 146B. With such a configuration, the first and second walls 146A, 146B are less likely to be worn due to friction caused by the rotation of the roller 49.

Each of the first and second holding members 170A, 170B has a surface having friction coefficient smaller than that of the support shaft 47 and the first and second walls 146A, 146B. Accordingly, the friction is less likely to be caused by the rotation of the roller 49 compared to a configuration where the roller 49 and the support shaft 47 are directly in contact with the walls 146A, 146B. Examples of methods of reducing the friction coefficient of the surface of the first and second holding member 170A, 170B are described below. The first and second holding members 170A, 170B may be made of material having a friction coefficient smaller than that of the first and second walls 146A, 146B and the support shaft 47. The first and second holding members 170A, 170B may be subjected to a surface treatment such as diamond-like carbon coating. The first and second holding members 170A, 170B, the support shaft 47, and the first and second walls 146A, 146B may not necessarily have the above-described relation. For example, the first and second holding members 170A, 170B may have a friction coefficient smaller than that of one of the support shaft 47 and the first and second walls 146A, 146B.

In the present embodiment, the second plate portion 173B has a curved shape such as a S-shape and is elastically in contact with the second end surface 47B of the support shaft 47. With such a configuration, no gap is between the support shaft 47 and each of the first and second plate portions 173A, 173B, and the support shaft 47 is held by the first and second plate portions 173A, 173B. In the present embodiment, it is not necessary for the second holding member 170B to be processed when mounted on the second wall 146B and the mounting work is improved.

<Other Embodiments>

The present technology is not limited to the above embodiments explained in the above description and the drawings. The technology described herein includes various modifications as described below.

(1) In the above embodiments, the roller bearing is described as the bearing 54. However, a ball bearing may be used as the bearing 54.

(2) In the above embodiments, the rocker arm 40 included in the intake-side valve drive device 20 is described. However, the rocker arm 40 may be used in a discharge-side valve drive device.

(3) In the second embodiment, the first holding member 170A may be mounted on each of the first and second walls 146A, 146B.

The invention claimed is:

1. A rocker arm comprising:

a roller to be contacted with a cam and having a rotation axis;

a support shaft having a columnar shape, extending along the rotation axis and coaxially mounted in the roller to rotatably support the roller, the support shaft having a first end portion and a second end portion;

walls including at least a first wall and a second wall extending perpendicular to the rotation axis and opposite each other with the roller located therebetween, the first wall having a first through hole through which the first end portion of the support shaft is inserted and the second wall having a second through hole through which the second end portion of the support shaft is inserted;

a bearing arranged between the support shaft and the roller; and plate portions including at least a first plate portion and a second plate portion arranged opposite each other with the first wall, the second wall and the support shaft located therebetween, the first plate portion being in contact with a first end surface of the first end portion of the support shaft and the second plate portion being in contact with a second end surface of the second end portion of the support shaft, wherein the first and second walls are parts of the rocker arm, the first wall is configured with a first plate member, the second wall is configured with a second plate member, and the first and second plate members are opposite to each other, and the first and second plate members each have plate surfaces that intersect the rotation axis of the roller.

2. The rocker arm according to claim 1, wherein the support shaft is held by the first wall, the second wall, the first plate portion, and the second plate portion so as to be rotatable with respect to the first wall, the second wall, the first plate portion, and the second plate portion.

3. The rocker arm according to claim 1, wherein the first plate portion and the second plate portion cover a rotation center, corresponding to the rotational axis, on the first end surface and the second end surface of the support shaft, respectively.

4. The rocker arm according to claim 1, wherein an outer plate surface of the plate surfaces of the first plate member is flush with the first end surface of the support shaft, and an outer plate surface of the plate surfaces of the second plate member is flush with the second end surface of the support shaft, and the first plate portion is in contact with the outer plate surface of the first plate member and the first end surface of the support shaft, and the second plate portion is in contact with the outer plate surface of the second plate member and the second end surface of the support shaft.

5. The rocker arm according to claim 1, wherein the first plate portion and the second plate portion are made of metal.

6. The rocker arm according to claim 1, further comprising a connection plate portion connecting the first plate portion and the second plate portion, wherein the support shaft has a first recess portion in a rotation center portion of the first end surface and has a second recess portion in a rotation center portion of the second end surface, the first plate portion has a first projection that is fit in the first recess portion, and the second plate portion has a second projection that is fit in the second recess portion.

7. The rocker arm according to claim 6, wherein an inner plate surface of the plate surfaces of the first plate member and an inner plate surface of the plate surfaces of the second plate member are in contact with the roller, an outer plate surface of the plate surfaces of the first plate member is in contact with the first plate portion, and an outer plate surface of the plate surfaces of the second plate member is in contact with the second plate portion.

8. The rocker arm according to claim 6, wherein the first plate portion, the second plate portion, and the connection plate portion configure a holding member, and the holding member holds the support shaft such that the support shaft is rotatable with respect to the first plate portion, the first wall, the second plate portion, and the second wall.

9. The rocker arm according to claim 6, wherein the connection plate portion is on an opposite side from the cam with respect to the roller.

10. A rocker arm comprising:

a roller to be contacted with a cam and having a rotation axis;

a support shaft having a columnar shape, extending along the rotation axis and coaxially mounted in the roller to rotatably support the roller, the support shaft having a first end portion and a second end portion;

walls including at least a first wall and a second wall extending perpendicular to the rotation axis and opposite each other with the roller located therebetween, the first wall having a first through hole through which the first end portion of the support shaft is inserted and the second wall having a second through hole through which the second end portion of the support shaft is inserted;

a bearing arranged between the support shaft and the roller;

plate portions including at least a first plate portion and a second plate portion arranged opposite each other with the first wall, the second wall and the support shaft located therebetween, the first plate portion being in contact with a first end surface of the first end portion of the support shaft and the second plate portion being in contact with a second end surface of the second end portion of the support shaft;

a first stopper portion disposed between the first wall and the roller and having a first insertion hole through which the support shaft is inserted; and a first connection plate portion connecting the first plate portion and the first stopper portion.

11. The rocker arm according to claim 10, further comprising:

a second stopper portion disposed between the second wall and the roller and having a second insertion hole through which the support shaft is inserted; and a second connection plate portion connecting the second plate portion and the second stopper portion.

12. The rocker arm according to claim 11, wherein the first plate portion and the second plate portion cover a rotation center, corresponding to the rotation axis, on the first end surface and the second end surface of the support shaft, respectively, and the second plate portion urges the support shaft toward the first plate portion.

13. The rocker arm according to claim 11, wherein the first stopper portion and the second stopper portion have a friction coefficient smaller than that of the first wall and the second wall.

14. The rocker arm according to claim 11, wherein the first connection plate portion is disposed on a surface of the first wall facing the cam and the second connection plate portion is disposed on a surface of the second wall facing the cam.

15. The rocker arm according to claim 11, wherein the first plate portion, the first stopper portion, and the first connection plate portion configure a first holding member, the second plate portion, the second stopper portion, and the second connection plate portion configure a second holding member, and the first holding member and the second holding member hold the support shaft such that the support shaft is rotatable with respect to the first wall, the first holding member, the second wall, and the second holding member.

16. The rocker arm according to claim 11, wherein each of the first wall and the second wall has an inner surface and an outer surface, the first stopper portion is in contact with the inner surface of the first wall and the second stopper portion is in contact with the inner surface of the second wall, the first plate portion is in contact with the outer surface of the first wall, the second plate portion extends from the second connection plate portion and includes a basal portion, a middle portion, and a distal end portion, the basal portion is continuous from the second connection plate portion and away from the outer surface of the second wall, the middle portion is in contact with a rotation center portion of the second end surface of the support shaft, and the middle portion urges the support shaft toward the first plate portion.

* * * * *